US005682577A

United States Patent [19]

Kiyoi

[11] Patent Number: 5,682,577

[45] Date of Patent: Oct. 28, 1997

[54] METHOD AND APPARATUS FOR CONTROLLING A TEMPERATURE OF A FIXING ROLLER IN AN PRINTING/ COPYING DEVICE

[75] Inventor: Hiroyuki Kiyoi, Kanagawa, Japan

[73] Assignee: Richoh Company, Ltd., Tokyo, Japan

[21] Appl. No.: 605,977

[22] Filed: Feb. 23, 1996

[30] Foreign Application Priority Data

| | | | |
|---|---|---|---|
| Feb. 24, 1995 | [JP] | Japan | 7-060014 |
| Apr. 26, 1995 | [JP] | Japan | 7-102255 |
| Sep. 5, 1995 | [JP] | Japan | 7-228208 |

[51] Int. Cl.[6] ..... G03G 15/20

[52] U.S. Cl. ..... 399/69; 219/494; 399/70

[58] Field of Search ..... 355/285, 208; 219/216, 469–471, 494, 482, 497, 501; 399/67, 69, 70, 33, 320

[56] References Cited

U.S. PATENT DOCUMENTS

| | | | |
|---|---|---|---|
| 5,249,062 | 9/1993 | Ejiri et al. | 358/296 |
| 5,465,141 | 11/1995 | Asano et al. | 355/285 |

FOREIGN PATENT DOCUMENTS

| | | |
|---|---|---|
| 2-161481 | 6/1990 | Japan . |
| 5-297758 | 11/1993 | Japan . |
| 6-308853 | 4/1994 | Japan . |

*Primary Examiner*—Arthur T. Grimley
*Assistant Examiner*—Quana Grainger
*Attorney, Agent, or Firm*—Dickstein Shapiro Morin & Oshinsky LLP

[57] ABSTRACT

In a fixing system used to an electrophotographic recording apparatus, when a fixing roller is heated to a temperature above a preset fixing temperature by a heater and then a thermistor senses that the surface temperature of the fixing roller falls below the fixing temperature, a heater controller energizes the heater for a predetermined driving time and then deenergizes of the heater for a predetermined heater interrupting time to thereby control the surface temperature of the fixing roller. The heater driving time and the heater interrupting time may be stored in a memory region in accordance with respective sizes of recording papers. The duty ratio of the heater may be changed when a predetermined number of images have been recorded or when the fixing system is continuously operated for longer than a predetermined time.

62 Claims, 6 Drawing Sheets

FIG. 5
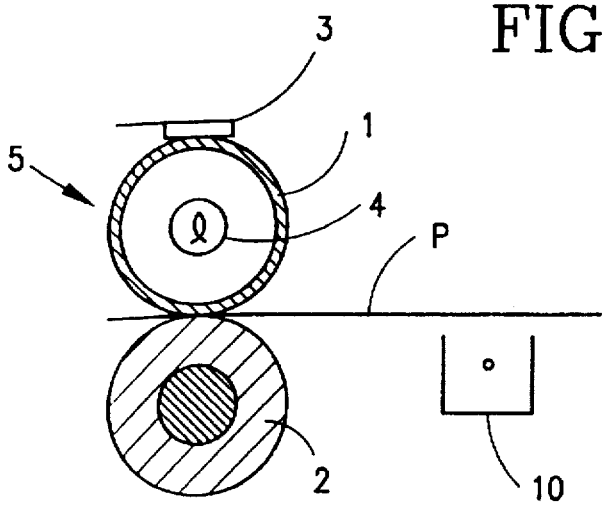
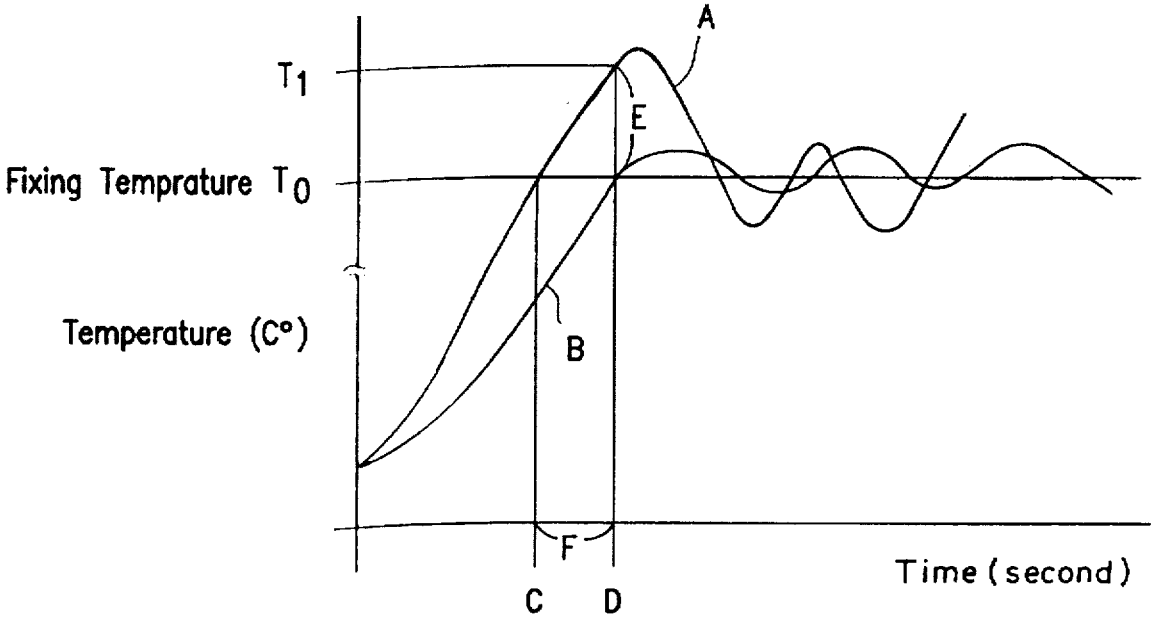
FIG. 6

METHOD AND APPARATUS FOR CONTROLLING A TEMPERATURE OF A FIXING ROLLER IN AN PRINTING/ COPYING DEVICE

BACKGROUND OF THE INVENTION

1. Field of the Invention

The present invention relates to a fixing system of an electrophotographic recording apparatus such as a copying machine, facsimile, printer and the like which fixes a toner image formed on a recording paper by pressing and heating it.

2. Description of the Related Art

FIG. 5 is a view showing an arrangement of a main portion of a fixing system commonly used in an electrophotographic recording apparatus. A fixing roller 1 contains an internal heater 4 and has an outer peripheral surface in contact with a temperature sensing means, such as a thermistor 3. A press roller 2 having an outer peripheral surface covered with silicon rubber, or the like, is in contact with the fixing roller 1 under pressure. A recording paper P to which a toner image is transferred by a transfer unit 10 is held and pressed between the fixing roller 1 and the press roller 2 and the toner image on the recording paper P is fixed thereto by being heated and pressed. In order to control the surface temperature of the fixing roller 1, the heater 4 is controlled in response to the temperature sensed by the thermistor 3 in contact with the surface of the fixing roller 1.

However, since the temperature sensed by the thermistor 3 cannot accurately follow the surface temperature of the roller 1, and since a time lag exists between them, there is a difference of temperature between a surface temperature A of the roller 1 and the temperature B corresponding to the surface temperature A which is sensed by the thermistor 3. Therefore, as shown in FIG. 6, even when the surface temperature A of the roller 1 reaches a fixing temperature $T_O$ at a time C, the temperature B sensed by the thermistor has not yet reached the fixing temperature $T_O$. Consequently, when the temperature B of the thermistor 3 reaches the fixing temperature $T_O$ at a time D, the surface temperature A of the fixing roller 1 has reached a temperature $T_O$ which is higher than $T_O$, and thus extra heat (width E) and time (width F) have been consumed. Further, when it is confirmed that the temperature B sensed by the thermistor 3 has reached the fixing temperature $T_O$ at the time D, and heating of the fixing roller 1 is stopped, the surface temperature A of the fixing roller abruptly drops and continues to drop past the fixing temperature $T_O$ earlier than the temperature B sensed by the thermistor 3. Therefore, even if it is confirmed that the dropping temperature B sensed by the thermistor 3 becomes lower than the fixing temperature $T_O$ and the fixing roller 1 is reheated, the surface temperature A of the fixing roller 1 is lower than the fixing temperature $T_O$.

As described above, when the fixing temperature is controlled in response to the temperature sensed by the thermistor 3, the fixing roller 1 is excessively heated, whereas the fixing roller 1 is excessively cooled after the heating ceases. As a result, there is a pronounced ripple effect in the surface temperature A of the fixing roller 1, and when fixing is carried out in this state, uneven and faulty fixing may occur. The difference between the surface temperature A of the fixing roller 1 and the temperature B sensed by the thermistor 3 mainly results from a thermal resistance between the thermistor 3 and the fixing roller 1, heat transfer to a structure through the support member of the thermistor 3, and a thermal response delay caused by the relationship of the thermal capacities of respective surrounding structures and the like.

Further, since the fixing roller 1 is thermally an open system, a significant ripple may be temporarily caused to the surface temperature of the fixing roller 1 when the heat balance between the fixing roller 1 and surrounding environment is greatly varied, or by other particular conditions. More specifically, when the recording papers P fed to the fixing system are greatly changed in size, the recording papers P have respective thermal capacities which are different in accordance with their size. Therefore, the quantity of heat which the recording papers P absorb from the fixing roller 1 is varied in accordance with the size of the recording papers and a ripple is caused to the surface temperature of the fixing roller 1 in correspondence with the quantity of heat absorbed by the recording papers P.

Further, when the temperature of components in the vicinity of the fixing roller 1, in particular the temperature of the press roller 2, is increased near to the fixing temperature in an electrophotographic recording apparatus, while the recording papers P are continuously fed to the fixing system and the surface temperature of the fixing roller 1 is maintained near to the high fixing temperature $T_O$ for a long time, an amount of heat transferred from the fixing roller to the outside world is greatly lowered. In this case, since the temperature of the fixing roller 1 is abruptly increased by being heated by the heater 4 and the heat dropping speed of the fixing roller 1 becomes very slow after it has been heated, a ripple which excessively increases the surface temperature of the fixing roller 1 with respect to the fixing temperature $T_O$ is likely to occur.

An object of the present invention is to provide a fixing system capable of heating the surface temperature of a fixing roller to a fixing temperature by a heating means, while restricting the ripple of the surface temperature as the fixing temperature is maintained, thereby preventing uneven and faulty fixing resulting from an excessive ripple in the surface temperature of the fixing roller.

SUMMARY OF THE INVENTION

To solve the above problems, a fixing system according to one aspect of the invention includes a fixing roller having associated heating means, a press roller in contact with the fixing roller under pressure for holding and transporting a recording paper between the fixing roller an the press roller to fix toner image on the recording paper and a temperature sensing means, such as a thermistor or other heat sensor, for sensing the surface temperature of the fixing roller. The fixing system further comprises a control means for energizing the heating means for a predetermined time and then interrupting the energization when the value of temperature sensed by the temperature sensor reaches a fixing temperature, and thereafter energizing the heating means for a predetermined time and deenergizing the heating means for a predetermined time, when the value of temperature sensed by the temperature sensor drops below the fixing temperature.

In another aspect, a fixing system according to the invention includes a fixing roller having associated heating means, a press roller in contact with the fixing roller under pressure for holding and transporting a recording paper between the fixing roller an the press roller to fix a toner image on the recording paper and a temperature sensing means, such as a thermistor or other heat sensor, for sensing the surface temperature of the fixing roller. The fixing system further comprises control means for energizing the heating means for a predetermined time and then interrupting the energization when the value of temperature sensed by the temperature sensor reaches a fixing temperature, and thereafter energizing the heating means for a predetermined time and deenergizing the heating means for a predetermined time just after the energization, when the value of temperature sensed by the temperature sensor drops below the fixing temperature, and thereafter fetching the value of temperature sensed by the temperature sensing means.

In yet another aspect, a fixing system according to the invention includes a fixing roller having associated heating means, a press roller in contact with the fixing roller under pressure for holding and transporting a recording paper between the fixing roller an the press roller to fix a toner image on the recording paper and a temperature sensing means, such as a thermistor or other heat sensor, for sensing the surface temperature of the fixing roller. The fixing system further comprises control means for continuously energizing the heating means until the value of temperature sensed by the temperature sensing means reaches a heater control boundary temperature, set lower than a fixing temperature, and repeating an energizing/deenergizing cycle set for a predetermined time until the fixing temperature is sensed after the heater control boundary temperature is reached.

In yet another aspect, the fixing system of the invention includes a fixing roller having associated heating means, a press roller in contact with the fixing roller under pressure for holding a recording paper between the fixing roller and the press roller and transporting the recording paper and fixing a toner image on the recording paper and temperature sensing means for sensing the surface temperature of the fixing roller, wherein the temperature sensing means senses a fixing temperature, a heater control boundary temperature and a paper feed start temperature which must be reached before papers can be fed and the heater control boundary temperature is set between the fixing temperature and the paper feed start temperature. The system further comprises a control means responsive to the temperature sensor for energizing the heating means in accordance with different energization patterns depending on whether the temperature sensed by the temperature sensor has reached the paper feed start temperature, the boundary temperature or the fixing temperature.

In yet another aspect, the fixing system of the invention includes a fixing roller having an associated heating means, a press roller in contact with the fixing roller under pressure for holding a recording paper between the fixing roller and the press roller and transporting and fixing a toner image on the recording paper and temperature sensing means for sensing the surface temperature of the fixing roller, with the fixing system comprising a recording unit for forming the toner image, a document reading unit for reading the image of a document, a network controller for receiving image information transmitted thereto, and a control means for starting the reception of a signal or a copy operation based on signal received by the network controller or a copy command signal from the document reading unit, the control means carrying out heating by the heating means, and when the value of temperature sensed by the temperature sensing means reaches the fixing temperature, interrupting the energization of the heating means after a predetermined time, and thereafter energizing the heating means for a predetermined time when the temperature sensed by the temperature sensing means drops below the fixing temperature and deengergizing the heating means for a predetermined time just after the energization, and stopping the energization of the heating means on the completion of the signal reception or the copy operation.

In yet another aspect, the fixing apparatus of the invention as just described further comprises control means for immediately interrupting the energization of the heating means when the value of temperature sensed by the temperature sensing means reaches the fixing temperature, after the sensed temperature value has first reached and then dropped below the fixing temperature.

In yet another aspect, the fixing system of the invention includes a fixing roller associated having associated heating means, a press roller in contact with the fixing roller under pressure for holding a recording paper between the fixing roller and the press roller and transporting the recording paper and fixing a toner image on the recording paper, a temperature sensing means for sensing the surface temperature of the fixing roller and control means for controlling the surface temperature of the fixing roller by energizing the heating means for a predetermined heater driving time and then deenergizing the heating means for a predetermined heater interrupting time, when the temperature sensing means senses the surface temperature of the fixing roller is below a preset fixing temperature after the fixing roller is heated above the fixing temperature by the heating means, wherein the control means changes a duty ratio of the heater driving time and the heater interrupting time in correspondence to the size of recording papers.

In yet another aspect, the fixing system of the invention includes a fixing roller having an associated heating means, a press roller in contact with the fixing roller under pressure for holding a recording paper between the fixing roller and the press roller and transporting the recording paper and fixing a toner image, which is formed on the recording paper by unfixed toner, by heating and pressing the toner image, temperature sensing means for sensing the surface temperature of the fixing roller and control means for controlling the surface temperature of the fixing roller by continuously energizing the heating means for a predetermined heater driving time and then continuously deenergizing the heating means for a predetermined heater interrupting time when the temperature sensing means senses that the surface temperature of the fixing roller is below a preset fixing temperature after the fixing roller has been heated above the fixing temperature by the heating means, wherein when the total sheet number of continuously fed recording papers reaches a preset threshold sheet number, or when the continuous operating time of the apparatus in which recording papers are continuously fed reaches a preset threshold time, the control means changes a duty ratio between the heater driving time and the heater interrupting time to a value different from an initially set value.

In yet another aspect, the control means of the fixing system of the invention as described in the preceding paragraph changes the duty ratio based the total sheet number by selecting a threshold sheet number in accordance with the size of fed recording papers, or changes the duty ratio based on the continuous operation time by selecting a threshold time in accordance with the size of the fed recording papers.

In yet another aspect, the control means of the fixing system of the invention as described in the preceding paragraphs sets the initial value of the duty ratio, and an amount of change in the duty ratio when the total sheet number reaches the threshold sheet number, or when the continuous operation time reaches the threshold time, in correspondence to the size of the fed recording papers, respectively.

The above and other objects, features, advantages and aspects of the invention will be more readily understood from the following detailed description of the invention which is provided in connection with the accompanying drawings.

BRIEF DESCRIPTION OF THE DRAWINGS

FIG. 5 is a view showing the arrangement of the main part of a fixing system used in a conventional electrophotograhic recording apparatus;

FIG. 6 is a graph showing the result of temperature measurement variations of a conventional fixing roller and thermistor;

DESCRIPTION OF PREFERRED EMBODIMENTS

A first embodiment of a fixing system of the present invention will be described below with reference to the drawings.

Figure 1:
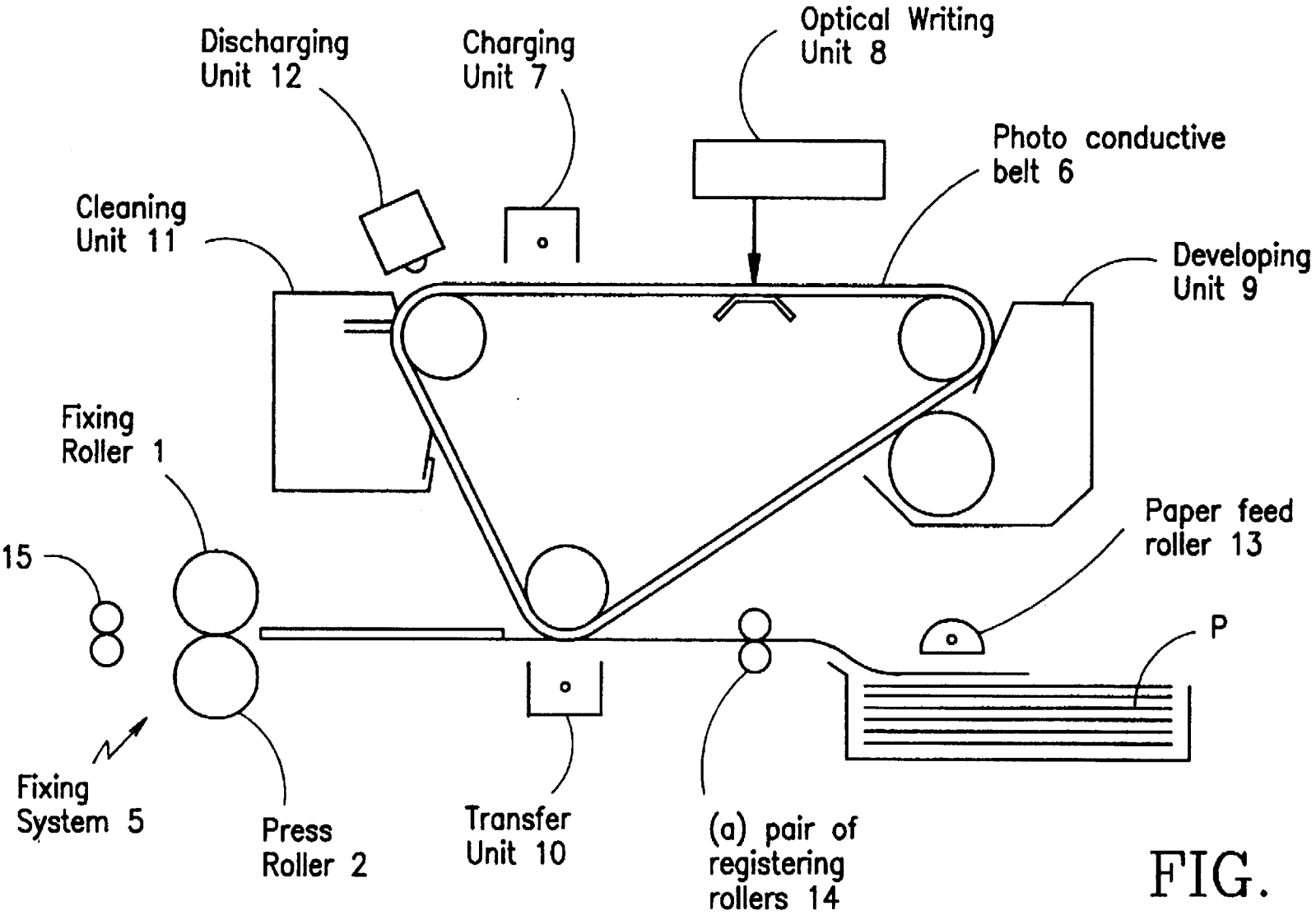
FIG. 1 is a schematic view showing the arrangement of an example of an electrophotographic recording apparatus to which the invention is applicable.

FIG. 1 is a schematic view showing an exemplary electrophotographic recording apparatus to which a first embodiment of the fixing system of the present invention is applicable. The same numerals as used for the components earlier described with reference to FIG. 5 are used again to denote the same components and a further description of such components is omitted. FIG. 1 shows a photoconductive belt 6. A charging unit 7, an optical writing unit 8, a developing unit 9, a transfer unit 10, a cleaning unit 11 and a discharging unit 12 are disposed in series around the photoconductive belt 6 in the sequence of an image forming process. Further, recording papers P are separated and fed by a paper feed roller 13 and transported by a pair of resist rollers 14, while being synchronized with the rotation of the photoconductive belt 6.

In the above arrangement, after an electrostatic latent image formed on a photoconductive surface by the optical writing unit 8 is developed to a toner image by the developing unit 9, the photoconductive belt 6 transfers the toner image onto the recording paper P, which is transported by a pair of resist roller 14, by the transfer unit 10. Thereafter, the toner image transferred onto the recording paper P is fixed by being heated and pressed by a fixing system 5 which includes a fixing roller 1 and a press roller 2, and the recording paper P is discharged from the apparatus by a pair of paper discharge rollers 15 after passing a paper discharging sensor 201.

Figure 2:
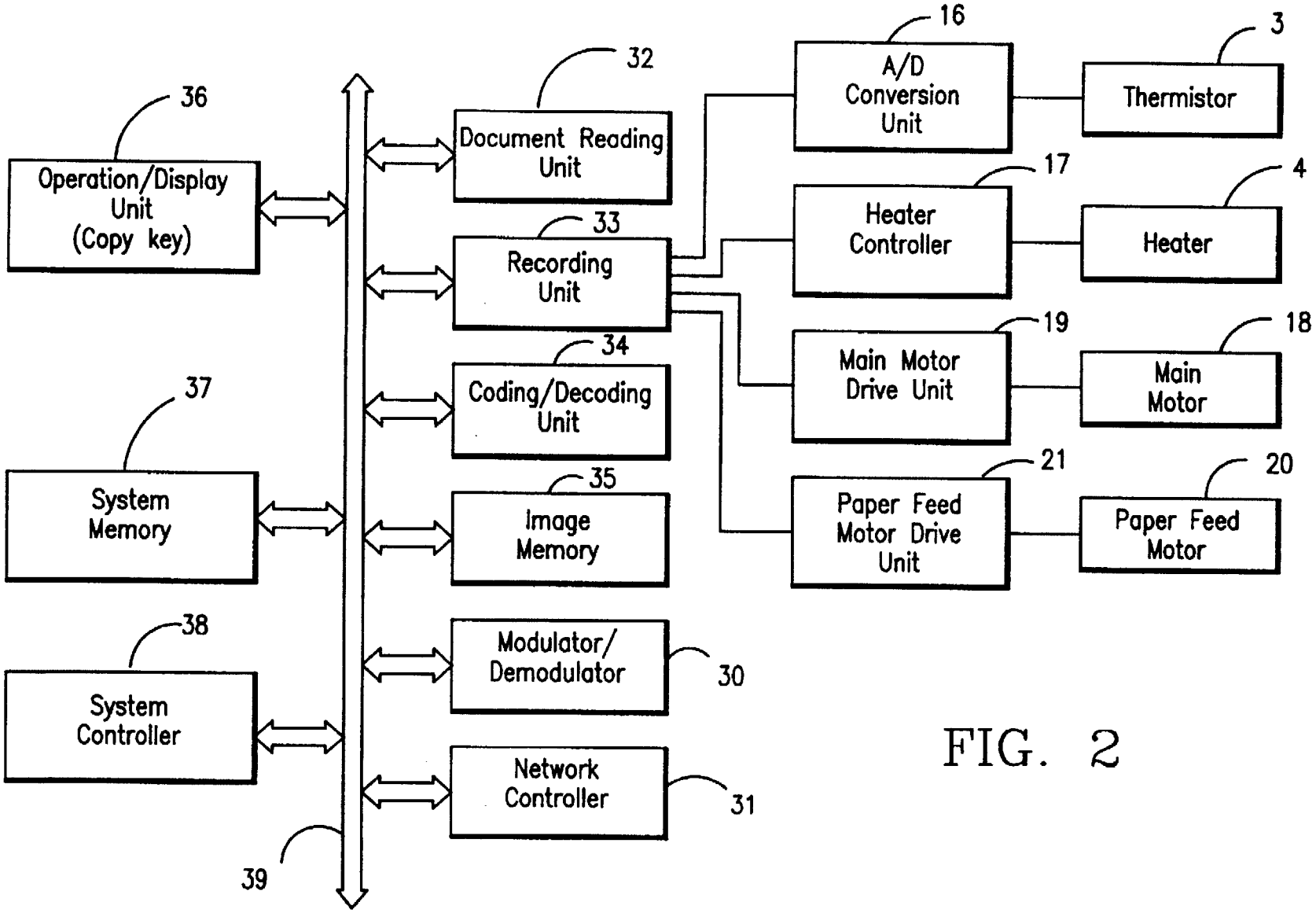
FIG. 2 is a block diagram of an electrophotographic recording apparatus using the fixing system according to an embodiment of the present invention.

FIG. 2 is a block diagram of an electrophotographic recording apparatus using the fixing system according to a first embodiment of the present invention. The electrophotographic recording apparatus includes a modulator/demodulator 30 for transmitting and receiving various sequence signals for controlling image information and transmission and a network controller 31 for controlling a predetermined circuit when the apparatus is connected to a telephone circuit and receiving and transmitting signals during communication with the outside world.

In FIG. 2, an A/D conversion unit 16 converts an analog temperature sensing signal from the thermistor 3 into a digital signal, a heater controller 17 controls the energization of the heater 4, a main motor drive unit 19 controls the rotation of a main motor 18, and a paper feed motor drive unit 21 controls the drive of a paper feed motor 20 for feeding the recording papers P, respectively. A document reading unit 32 reads a document image and a recording unit 33 records the document image read by the document read unit 32, or records image information received from the outside world. A coding/decoding unit 34 compresses a document image to be transmitted, or decompresses received image information and restores it to original image information. An image memory 35 accumulates the image information of a transmitting document, or received image information as necessary. An operation/display unit 36 ms used by the operator for inputting and controlling various operations, as well as displaying the operating state and the like of the apparatus. A system memory 37 stores preregistered information and information to be temporarily maintained for communication. A system controller 38 composed of a microcomputer controls the above respective units, and a system bus 39 interconnects the above respective units, transmitting various control signals and data therebetween. A paper discharge sensor 201 is also coupled to the system controller 38.

Figure 3:
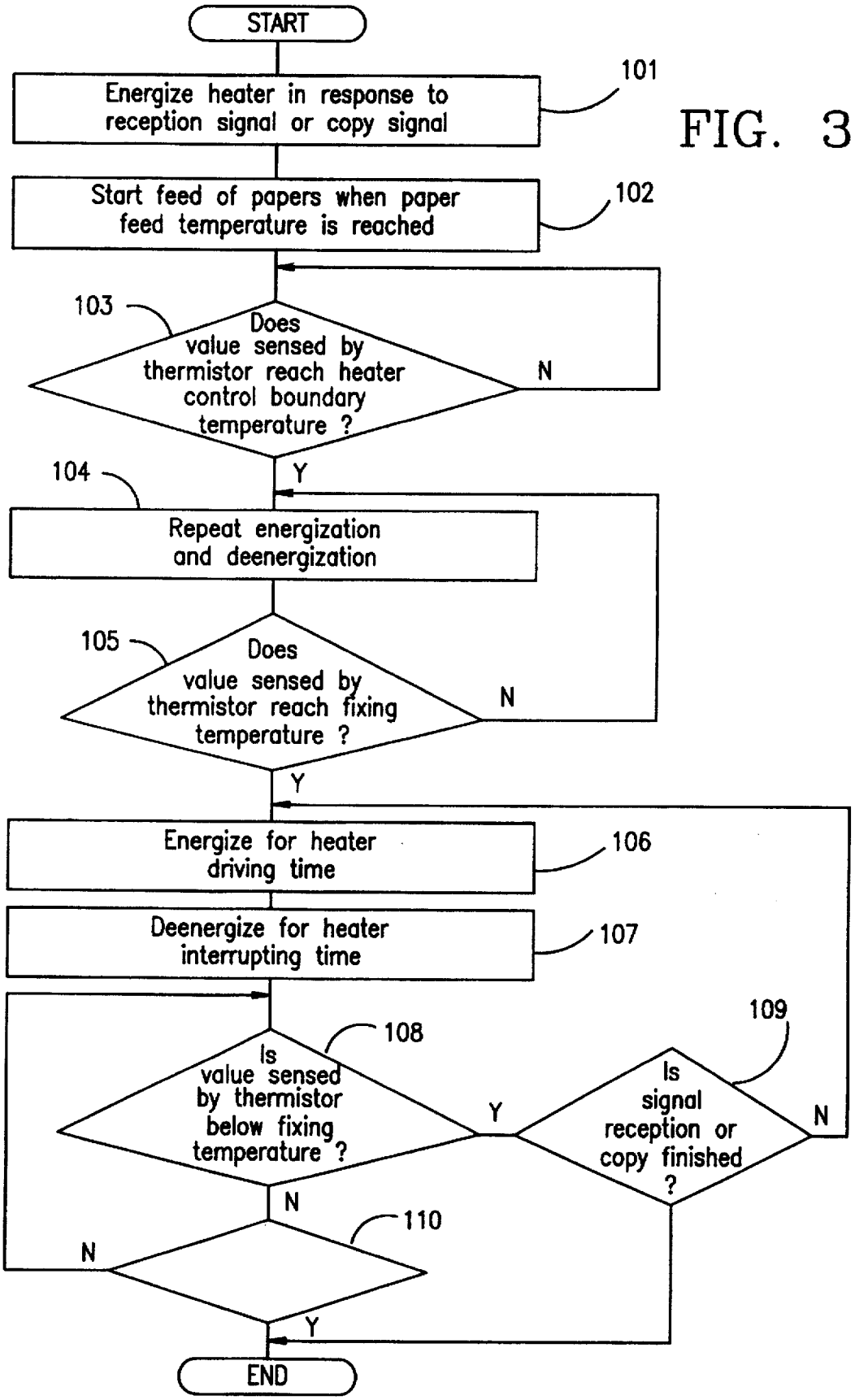
FIG. 3 is a flowchart showing operation of the fixing system of the FIG. 2 embodiment of the invention.

Referring now to FIGS. 2 and 3, when a receiving signal is input to the electrophotographic recording apparatus from other apparatus, or a copy signal is input thereto, the heater 4 is energized by the heater controller 17 and starts to heat the fixing roller 1 (step 101). Next, the thermistor 3 in contact with the fixing roller 1 senses the surface temperature of the fixing roller 1 and when the temperature reaches a paper feed temperature, the system controller 38 detects this and starts the feeding of the recording papers P (step 102). The fixing roller 1 is further heated by the heater 4 and the system controller 38 determines whether a heater control boundary temperature has been reached or not (step 103). When the boundary temperature has been reached, predetermined temperature increasing time control data stored in the system memory 37 is read out and fetched by the system controller 38 and the heater 4 is switched by system controller 38 from a control mode where the heater 4 is continually energized to a control mode for alternately energizing and deenergizing the heater 4 through the heater controller 17 and this control mode is continued until the value sensed by the thermistor 3 reaches a fixing temperature (step 104). The system controller 38 determines whether the value sensed by the thermistor 3 has reached the fixing temperature or not (step 105), and if reached, predetermined initial value setting data stored in the system memory 37 is read out and used for controlling heater 4.

The initial value setting data is data for setting the initial value of heater driving time as a predetermined time for continuously energizing the heater 4 and data for setting the initial value of heater interrupting time as a predetermined time for continuously deenergizing the heater 4 after it is energized during the heater driving time following when the fixing temperature is reached. The data thus establishes an "on/off" duty cycle for energization of heater 4. The heater controller 17 then energizes the heater 4 for the heater driving time set by the initial value setting data (step 106) and then deenergizes the heater 4 for the heater interrupting time set by the initial value setting data (step 107). Thereafter, the system controller 38 monitors the value sensed by the thermistor 3 to determine whether the sensed temperature value falls below the fixing temperature (step 108). When the sensed value falls below the fixing temperature (Y of step 108), system controller 38 determines whether a signal reception, or a copy operation, is finished (step 109). In the case of a signal reception, this indicates that there are no more transmissions to be received from a sending facsimile machine. In the case of a copy operation this means that there are no more originals to be copied. When a signal reception or a copy operation is not finished (N to step 109), the process returns to the entrance of step 106 and reexecutes step 106 and step 107, whereas when the signal reception or copy operation is finished (Y of step 109), these steps are ended. Further, when the sensed value exceeds the fixing temperature (N of step 108), it is determined whether the signal reception or copy operation is finished (step 110), and when the signal reception or copy operation is not finished (N of step 110), the heater 4 is continuously deenergized and the process returns to the entrance of step 108. When the signal reception or copy operation is finished (Y of step 110), this step is finished.

A sensor 201 is used to count reproduced documents as they exit the system. This count is used to determine when fixing of a last received facsimile image, or a last image for a copy operation, is completed. In a facsimile system, a MPS (Multi-Page Signal) signifies termination of the first page transmission from the transmitting side to the receiving side during the time period between one page and the next page of the manuscript documents. And further, when all of the manuscript documents are transmitted and the operation of the facsimile device terminates, an EOP signal (End-of-Procedure Signal) is sent from the transmitting side signifying termination of the last page transmission. Those signals are taken in through the network controller 31 and into the system controller 38 and the same are read out in the same system controller 38.

The system controller 38 counts the above-mentioned MPS signal, and by doing so knows the total number of the received manuscript documents from the counted MPS value at the time of receiving the EOP signal.

Thus, when the received pages are fixed, the paper discharging sensor 201 detects passage of the discharge recording paper, and the detection signal is also output to the system controller 38. The system controller 38 counts the detection signal and judges that all of the operations of the manuscript document image printing are completed when the counting value from sensor 201 reaches the above-mentioned total number of the received manuscript documents.

Furthermore, when a copying operation is performed, since the number of the copied sheets is input by an operator form the operation/display control unit 36, the system controller 38 judges that all of the copying operations are completed when the counting value of the detection signal from sensor 201 reaches the number of the input sheets to be copied.

As described above, according to the fixing system of the invention, the heater 4 is continuously energized until the value sensed by the thermistor 3 reaches the heater control boundary temperature. When the boundary temperature has been reached, the heater 4 is subjected to an energizing/deenergizing (on/off) cycle control (Ha, Hb) to prevent the surface temperature of the fixing roller 1 from being excessively increased. This continues until the value of temperature sensed by the thermistor 3 reaches the fixing temperature, at which time the heater is energized for one cycle of energization and deengerization (Ha, Hd). Then, whenever the sensed temperature falls below the fixing temperature, another cycle of energization and deenergization (Hc, Hd) is carried out so that the ripple of the surface temperature of the fixing roller 1 is suppressed to a low level.

Figure 4:
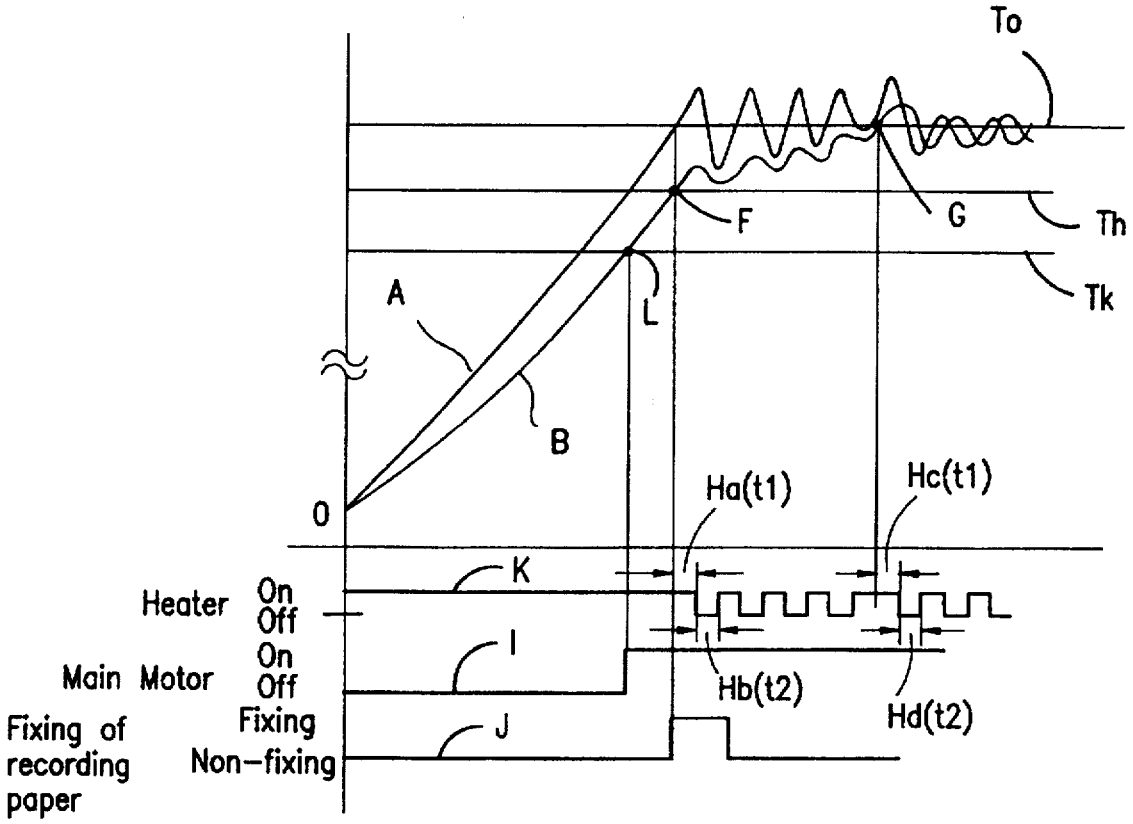
FIG. 4 is a graph showing the result of measurement of temperature variations of a fixing roller and a thermistor according to the FIG. 2 embodiment of the invention.

FIG. 4 is a graph showing the result of measurement of temperature variations of the fixing roller and the thermistor according to the fixing system of the just described embodiment of the present invention, wherein the ordinate represents temperature and the abscissa represents elapsed time. A point O indicates the start of heating of the fixing roller 1. At that time, the surface temperature of the fixing roller 1 is the same as the value sensed by the thermistor 3. A curve A represents the actual surface temperature of the fixing roller 1 obtained from a thermocouple and a curve B represents the temperature of the fixing roller 1 sensed by the thermistor 3. A temperature difference between both the curves is caused from a delay of thermal response of the thermistor 3 and other factors noted earlier.

A point F represents the point where the temperature sensed by the thermistor 3 reaches a heater control boundary temperature Th at which the surface temperature curve A of the fixing roller 1 has reached a temperature at or near a fixing temperature $T_0$. A point L before the point F indicates a paper feed start temperature Tk and a point G after the point F indicates when the sensed temperature B reaches the fixing temperature $T_0$.

A line I represents the operating state of the main motor 18 which starts operation at the point L. A line J represents the fixing state of a recording paper P passing through the fixing system 5 and the fixing of the recording paper P is started at the timing of the point F. A line K represents the energizing period and the deenergizing period of the heater 4. After the value of the temperature sensed by the thermistor 3 reaches the heater control start temperature Th (point F), the heater 4 is repeatedly subjected to a cycle composed of energization for a heater driving time Ha and deenergization for a heater interrupting time Hb each set by temperature increasing time control data until the temperature sensed by the thermistor 3 reaches the fixing temperature $T_0$. After the sensed temperature reaches the fixing temperature $T_0$, the heater 4 is subjected to a cycle composed of energization for a heater driving time Hc and deenergization for a heater interrupting time Hd each set by stored initial value setting data. Thereafter, each time the temperature sensed by the thermistor 3 drops below the fixing temperature $T_0$, the cycle composed of the energization for the heater driving time Hc and the deenergization for the heater interrupting time Hd is carried out (see steps 106–109 of FIG. 3 ).

As described above, after the sensed temperature of the fixing roller 1 reaches the fixing temperature $T_0$, the heater 4 is controlled by the temperature sensed by the thermistor 3 and the stored initial value setting data. For example, the heater driving time Hc may be set to 1.5 seconds and the heater interrupting time Hd may be set to 1.5 seconds, but these are just examples of a energization/deengerization cycle which may be used.

The duty ratio (D) is defined as D=heater driving time Hc/heater interrupting time Hd. The initial value setting data includes data for setting at least the duty ratio D. The heater controller 17 prestores data for setting the heater interruption time Hd in its fixed memory and thus calculates the heater driving time Hc as (duty ratio D×heater interrupting time Hd) by fetching the initial value setting data D and storing it in a buffer and then calculating Hc. That is, the heater controller 17 processes the duty ratio D as a stored variable and unconditionally determines the heater driving time Hc and heater interrupting time Hd by using the duty ratio D as the variable. Of course, the heater driving time Hc or (heater driving time Hc+heater interrupting time Hd) may be stored in the fixed memory of the heater controller 17 as a constant. Thus, when the heater driving time Hc is set as the constant, the heater interrupting time Hd is varied depending upon duty ratio D, whereas when (heater driving time Hc+heater interrupting time Hd) is set as the constant, both the heater driving time Hc and the heater interrupting time Hd are varied depending upon the duty ratio D. The constants set to the fixed memory may be determined based on the characteristics of the fixing system 5, the feeding frequency of the recording papers P, and the like.

The electrophotographic recording apparatus described with reference to FIG. 1 and FIG. 2 may also be arranged such that a recording paper sensor (not shown) senses the size of the recording paper P on which an image is to be recorded and outputs the size of the recording paper P to the system controller 38 which outputs the size of the recording paper P to be fed to the fixing system 5 to the heater controller 17 through the recording unit 33. Further, the system memory 37 includes a plurality of recording regions corresponding the sizes of the recording papers P, respectively on which the apparatus can record an image and these recording regions store different initial value setting data and initial value changing data, respectively. Thus, the paper size, and/or size of recording region, can be used to affect the duty cycle applied by the heater controller 17.

Any one of a first control mode and a second control mode may also be set for the heater controller 17 of the present invention, depending upon hardware setting employed in assembly, or by loading a different control program, or by changing parameters of the control program. The first control mode is designed for a fixing system which is applied to an electrophotographic recording apparatus having a relatively slow recording speed for the recording paper P, while the second control mode is designed for a fixing system which is applied to an electrophotographic recording apparatus having a relatively fast recording speed for the recording paper P.

When the first control mode is set, it suffices to store only different initial value setting data corresponding to the sizes of the recording papers P in the system memory 37, respectively, and the initial value changing data need not be stored. Thus, when the first control mode is set, the heater controller 17 reads the initial value setting data from the recording region corresponding the size of the recording paper P being fed in the system memory 37 at step 105 shown in FIG. 3. With this operation, the heater controller 17 reads the duty ratio D corresponding to the size of the recording paper P and calculates the heater driving time Hc based on the duty ratio D corresponding to the size of the recording paper P and prestored value of Hd.

More specifically, a large duty ratio D is stored as the initial value setting data in the recording region corresponding to a relatively large size recording paper P and a small duty ratio D is stored as the initial value setting data in the recording region corresponding to a relatively small size recording paper P. That is, since the heater interrupting time Hd is given, when the relatively large size recording paper P is fed, the heater controller 17 increases the heater driving time Hc so as to increase a quantity of heat to be supplied to the fixing roller 1 in a cycle, whereas when the relatively small size recording paper P is fed, the heater controller 17 reduces the heater driving time Hc so as to reduce a quantity of heat to be supplied to the fixing roller 1 in a cycle.

According to the control effected by the first control mode, even if the size of the recording paper P to be fed to the fixing system 5 changes and thus the quantity of heat which the recording papers P absorb from the fixing roller changes, the heater controller 17 changes the duty ratio D in correspondence to the size of the recording papers P being fed and sets the heater driving time Hc based on the duty ratio D corresponding to the size of the recording paper P. Thus, when fixing is carried out to the large size recording papers P with a large thermal capacity, a quantity of heat to be supplied to the fixing roller 1 can be increased, whereas when fixing is carried out on small size recording papers P with a small thermal capacity, a quantity of heat to be supplied to the fixing roller 1 can be reduced. As a result, the heater 4 can supply heat to the fixing roller 1 so as to compensate the change of the quantity of heat absorbed by the recording papers P so that the ripple of the surface temperature of the fixing roller 1 can be suppressed.

When the second control mode is set, different initial value setting data and different initial value changing data are stored to the recording regions corresponding to the sizes of the recording papers P in the system memory 37, respectively. The initial value changing data is data representing an amount of reduction d of the duty ratio D and a threshold sheet number n as a positive integer. When the second control mode is set, the heater controller 17 reads the initial value setting data D and initial value changing data d, n from the recording region corresponding the size of the recording papers P being fed in the system memory 37 at step 105 shown in FIG. 3. With this operation, the heater controller 17 reads the duty ratio D, amount of reduction of the duty ration d, and threshold sheet number n corresponding to the size of the recording papers P.

Figure 7:
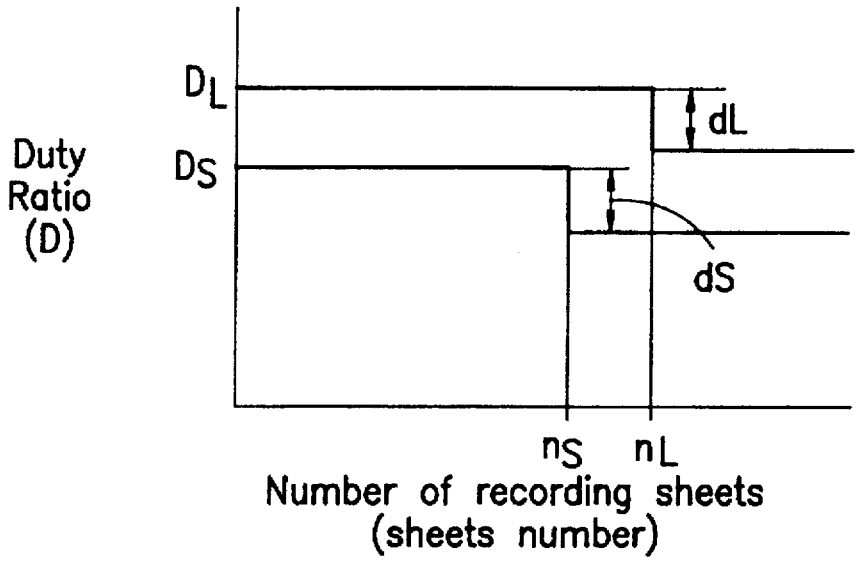
FIG. 7 is a graph explaining set patterns of a duty cycle when a second control mode is used in the fixing system of another embodiment of invention.

FIG. 7 is a graph explaining set patterns of the duty ratio when the second control mode is set in the fixing system of the invention. Note, the set patterns of the duty ratio D for recording papers P with a maximum size and minimum size will be described in FIG. 7 to simplify the description. However, this is merely exemplary as a number of sizes of papers can be used. Thus, the duty ratio D when a recording paper P with an intermediate size between the maximum size and minimum size may be set to an intermediate value between the set pattern representing the duty ratio D of the maximum size recording paper P and the set pattern representing the duty ratio D of the minimum size recording paper P, in accordance with the thermal capacity of the recording paper P.

The heater controller 17 first calculates the heater driving time Hc based on the initial value of the duty ratio D corresponding to the size of the recording papers P. When the initial value of the duty ratio D corresponding to the maximum size recording paper P is represented by $D_L$ and the initial value of the duty ratio D corresponding to the minimum size recording paper P is represented by $D_s$, the relationship between these initial values is represented by initial value $D_L$>initial $D_s$ as in the case of the first control mode.

When the signal reception or copy operation is not finished (either step 109 or 110 of FIG. 3) and the recording papers P are continuously fed, the heater controller 17 repeats the energization/deenergization of the heater 4 so that the surface temperature of the fixing roller 1 is set near to the high fixing temperature $T_0$ as shown in the flowchart FIG. 3. The heater controller 17 includes a counter (not shown) for totaling the number of the fed recording papers P when they are continuously fed and resets the total value of the counter when the signal reception or copy operation is finished. The input for the counter comes from sheet sensor 201.

When the number of the recording papers P totaled by the counter amounts to the preset threshold sheet number n in the second control mode, the heater controller 17 subtracts the amount of reduction d from the initial value of the duty ratio D to reduce the absolute value of the duty ratio D. Since the heater controller 17 reads the initial value changing data from the recording region of the system memory 37 in correspondence to the size of the recording paper P at the time, the threshold sheet number n and amount of reduction d as the contents of the initial value changing data are set to different values for each size of the recording papers P.

More specifically, when the threshold sheet number n corresponding to the maximum size recording papers P is represented by $n_L$ and the threshold sheet number n corresponding to the minimum size recording papers P is represented by $n_g$, the relationship between the threshold sheet numbers n is (threshold sheet number $n_L$)>(threshold sheet number $n_g$). Further, when the amount of reduction d to the maximum size recording papers P is represented by $d_L$ and the amount of reduction d to the minimum size recording papers P is represented by $d_g$, the relationship between the amounts of reduction d is set to (amount of reduction $d_L$)>(amount of reduction $d_g$).

According to the control effected by the second control mode, even if the size of the recording papers P to be fed to the fixing system 5 changes and thus the quantity of heat which the recording papers P absorb from the fixing roller 1 changes, the heater controller 17 changes the initial value of the duty ratio D in correspondence to the size of the recording papers P being fed and sets the heater driving time Hc based on the initial value of the duty ratio D corresponding to the size of the recording papers. Consequently, when fixing is carried out on large size recording papers P with a large thermal capacity, a quantity of heat to be supplied to the fixing roller 1 is increased, whereas when fixing is carried out to the small size recording papers P with a small thermal capacity, a quantity of heat to be supplied to the fixing roller 1 is reduced. As a result, heat is supplied to the fixing roller 1 by the heater 4 to compensate for the change in the quantity of heat absorbed by the recording papers P so that the ripple of the surface temperature of the fixing roller 1 can be suppressed.

When the total number of continuously fed recording papers P amounts to the preset threshold sheet number n, the heater controller 17 subtracts the amount of reduction d corresponding to the size of the recording papers P from the initial set value of the duty ratio D to thereby continuously maintain the surface temperature of the fixing roller 1 near to the high fixing temperature $T_0$ for a long period of time. Consequently, even if the components in the vicinity of the fixing roller 1, in particular, the press roller 2 is near a high temperature near to the fixing temperature $T_0$, the quantity of heat supplied by the heater 4 can be reduced by reducing the heater driving time Hc to compensate the reduction of heat transferred to the external components from the fixing roller 1 in the fixing operation. As a result, the occurrence of excess ripple can be prevented.

The heater control circuit 17 sets the threshold sheet number n in correspondence to the size of the recording paper P. Therefore, even if the quantity of heat which the recording papers P absorb from the fixing roller 1 is changed depending upon the size of the recording papers P and thus the temperature increasing speed of the components in the vicinity of the fixing roller 1 is changed, the initial value of the duty ratio D can be reduced in correspondence to the reduction of heat transferred to the external components from the fixing roller 1 at a time the temperature of the components in the vicinity of the fixing roller is increased to such a high temperature as to influence the temperature control of the fixing roller 1.

The heater controller 17 sets the amount of reduction d from the initial value of the duty ratio D in correspondence to the size of the fed recording paper P. Therefore, even if a plurality of types of recording papers P each having a different size are fed and the quantity of heat which the recording papers P absorb from the fixing roller 1 is changed, a new duty ratio D can be set to compensate the change of the quantity of absorbed heat caused by the sizes of the recording papers P. In addition, the initial value of the duty ratio D can be reduced to reduce the heat to be transferred from the fixing roller 1 to the external components at a time when the temperature of the components in the vicinity of the fixing roller is increased to such a high temperature as to influence the temperature control of the fixing roller 1. As a result, the ripple of the surface temperature of the fixing roller 1 can be suppressed without the influence of the size of the recording papers P.

Further, although the duty ratio D is reduced in the above described second control mode when the total sheet number of the continuously fed recording papers P counted by the counter reaches a threshold sheet n, the duty ratio D may instead be reduced in this second control mode when a continuous operation time totaled by a timer, during which the recording papers P are continuously fed and the temperature of the fixing roller 1 is maintained near to the fixing temperature $T_0$, reaches a preset threshold time.

Figure 8:
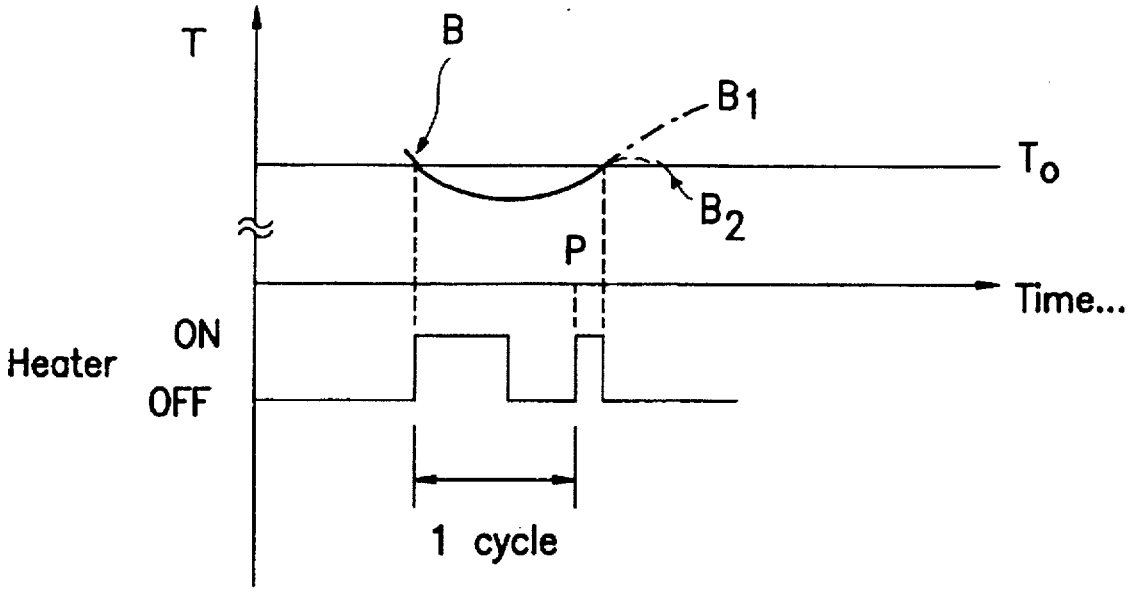
FIG. 8 is a graph explaining a portion of the heater control provided in the invention.

FIG. 8 shows another aspect of the heater control provided by the invention. In prior embodiments of the invention when the heater is being on/off controlled after the thermistor 3 first reaches a fixing temperature $T_0$, then falls below it, and then reaches the fixing temperature $T_0$ once again, there is a possibility of overheating the fixing roller. The reason for this, as shown in FIG. 8, is when the detection temperature B is equal to or less than the fixing temperature $T_0$ at a time point P (which occurs after the time point G in FIG. 4) when the operation of one cycle of the heater ON-OFF (turning-on and turning-off of the heater) terminates, another cycle of heater ON-OFF immediately begins at the time point P.

However, since the detection temperature B now being to rise, if the operation of a complete cycle of heater ON-OFF is performed from the time point P, the detection temperature may excessively rises up as shown by a dash-and-dot line B1 in FIG. 8.

To avoid this, when the detection temperature B reaches $T_0$, the heater is forcibly turned off, even though the normal heater control (duty ratio) dictates that the heater should continue to be turned on. As a result of this early termination of the normal energization period in the duty cycle, the detection temperature changes as shown by a dotted line B2 in FIG. 8, and an excessive increase of the heater temperature can be suppressed.

In all of the foregoing embodiments the heater 4 is energized and deenergized in accordance with a duty cycle to produce the ON and OFF heater control pulses (Ha, Hb, Hc and Hd) shown in FIG. 4. The particular width of the ON and OFF pulse periods may also be determined in consideration of one or more of the: thermal capacitance of the fixing roller and pressurizing roller, the electric power of the heater, transporting speed of the paper, input electric power, response property of the temperature sensor, e.g., thermistor, the image area of a recording paper, and the ambient temperature inside the machine.

As described above, the invention in its many aspects is designed to reduce the magnitude of the ripple temperature on the surface of the fixing roller to minimize the chance of uneven and faulty fixing of an image.

While several exemplary embodiments and variants of the invention have been described in detail above in connection with the drawings, the invention is by no means limited by the foregoing description. For example, specific structures have been described and illustrated as exemplary structures for carrying out the invention, but they are not critical as other structures may be used equal as well. For example, various functional components are illustrated in FIG. 2 as discrete elements. The functions of these components may be combined together into a single controller, if desired. Also, many of the functional units shown in FIG. 2 may be implemented in either hardware or software with equal facility. Accordingly, the invention is not limited by the foregoing description and drawings, but is only limited by the scope of the appended claims.

I claim:

1. A fixing system comprising a fixing roller having associated heating means for heating said fixing roller, a press roller in contact with the fixing roller under pressure for holding and transporting a recording paper between the fixing roller and the press roller to fix a toner image on the recording paper, and a temperature sensor for sensing the temperature of the fixing roller, said system further comprising control means for energizing said heating means for a first period of time and then deenergizing the heating means for a second period of time after the value of temperature sensed by said temperature sensor reaches a fixing temperature, and thereafter energizing said heating means for a third predetermined time and then deenergizing said heating means for a fourth predetermined time, when the value of temperature sensed by said temperature sensor drops below the fixing temperature.

2. A fixing system as in claim 1, wherein said control means initiates a repeated energization and deenergization pattern of said heating means after a boundary temperature, which is less than said fixing temperature, is sensed by said temperature sensor.

3. A fixing system as in claim 1, wherein said predetermined periods of time are stored in a memory.

4. A fixing system as in claim 2, wherein said control means further operates to continuously energize said heating means upon the initiation of a copying or image receiving operation, until said temperature sensor senses said boundary temperature.

5. A fixing system as in claim 4, wherein said control means initiates a paper feed operation by said fixing system when said temperature sensor first senses a paper feeding temperature which is below said boundary temperature.

6. A fixing system as in claim 4, wherein said control means stops all energizing of said heating means when a copying or image receiving operation ceases.

7. A fixing system as in claim 1, wherein said periods of time for energizing and deengerizing said heating means are defined by duty ratio information which is stored in a memory.

8. A fixing system as in claim 7, wherein said memory stores initial energization/deenergization period information for each of a plurality of selectable recording paper sizes, said system further comprising means for indicating the size of a selected recording paper to be fixed, said control means being responsive to said indicating means and retrieving and using the initial energization/deenergization time period information corresponding to said indicated paper size for controlling said heater means.

9. A fixing system as in claim 8, wherein said memory stores for each of said selectable recording paper sizes, as said initial energization/deenergization information, an initial value for an energization/deengerization ratio for said heater means and at least one of: (1) a heating means "on" time, (2) a heating means "off" time, and (3) a heating means total cycle time, said control means determining the initial energizing and deenergizing time periods from said initial energization/deengerization information.

10. A fixing system as in claim 9, wherein said ratio and at least one of (1) a heating means "on" time, (2) a heating means "off" time, and (3) a heating means total cycle time are based on thermal characteristics of said fixing system.

11. A fixing system as in claim 9, wherein said ratio and at least one of (1) a heating means "on" time, (2) a heating means "off" time, and a heating means total cycle time are based on the feeding frequency of said recording papers.

12. A fixing system as in claim 8, further comprising a recording paper counter for counting the number of recording papers which are fixed, said memory further storing energization/deenergization changing information and a sheet threshold number for each of said plurality of selectable recording paper sizes, said control means changing said initial energization/deenergization information, selected in accordance with the size of the recording paper, in accordance with said energization/deenergization changing information, and using the changed energization/deenergization information to control said heating means when said counter reaches the threshold sheet number corresponding to the size of the selected recording paper.

13. A fixing system as in claim 8, further comprising a timer for counting a continuous operation time of said fixing system, said memory further storing energization/deengerization changing information and a predetermined continuous operation time for said fixing system, said control means changing initial energization/deengerization information, in accordance with said energization/deengerization changing information, and using the changed energization/deengerization information to control said heating means when said timer reaches said predetermined continuous operation time.

14. A fixing system as in claim 13, wherein said memory means stores, as said initial energization/deenergization information, an initial value for an energization/deengerization duty ratio and at least one of: (1) a heating means "on" time, (2) a heating means "off" time, and a heating means total cycle time, said control means determining the initial energizing and deenergizing time periods from said initial energization/deengerization information.

15. A fixing system as in claim 14, wherein said ratio and at least one of: (1) a heating means "on" time, (2) a heating means "off" time, and (3) a heating means total cycle time are based on thermal characteristics of said fixing system.

16. A fixing system as in claim 14, wherein said ratio and at least one of: (1) a heating means "on" time, (2) a heating means "off" time, and (3) a heating means total cycle time are based on the feeding frequency of said recording papers.

17. A fixing system as in claim 7, wherein said memory stores initial energization/deenergization period information, said control means retrieving and using the initial energization/deengerization period information for controlling said heater means.

18. A fixing system as in claim 17, wherein said memory stores as said initial energization/deengerization period information, an initial value for an energization/deenergization ratio for said heating means, and at least one of: (1) a heating means "on" time, (2) a heating means "off" time and (3) a heating means total cycle time, said control means determining initial energization and deengerization time periods from said initial energization/deengerization information.

19. A fixing system as in claim 18, wherein said duty ratio and at least one of (1) a heating means "on" time, (2) a heating means "off" time, and (3) a heating means total cycle time are based on the thermal characteristics of said fixing system.

20. A fixing system as in claim 18, wherein said duty ratio and at least one of: (1) a heating means "on" time, (2) a heating means "off" time, and (3) a heating means cycle time are based on the characteristics of the feeding frequency of said recording papers.

21. A fixing system as in claim 17, further comprising a recording paper counter for counting the number of recording papers which are fixed, said memory further storing energization/deenergization changing information and a sheet threshold number for each of said plurality of selectable recording paper sizes, said control means changing said initial energization/deenergization information, selected in accordance with the size of the recording paper, in accordance with said energization/deenergization changing information, and using the changed energization/deenergization information to control said heating means when said counter reaches the threshold sheet number corresponding to the size of the selected recording paper.

22. A fixing system as in claim 1, wherein said control means further operates to immediately interrupt energization of said heating means when the value of temperature sensed by said temperature sensor reaches said fixing temperature.

23. A fixing system as in claim 1, wherein at least one of said energization and deenergization periods is set, at least in part, in accordance with the thermal capacitance of the fixing roller and pressing roller.

24. A fixing system as in claim 1, wherein at least one of said energization and deenergization periods is set, at least in part, in accordance with the thermal capacitance of the electric power of the heater means.

25. A fixing system as in claim 1, wherein at least one of said energization and deenergization periods is set, at least in part, in accordance with the thermal capacitance associated with image area of said recording paper.

26. A fixing system as in claim 1, wherein at least one of said energization and deenergization periods is set, at least in part, in accordance with the thermal capacitance associated with the line velocity of the recording paper.

27. A fixing system as in claim 1, wherein at least one of said energization and deenergization periods is set, at least in part, in accordance with the thermal capacitance of the input electric power.

28. A fixing system as in claim 1, wherein at least one of said energization and deenergization periods is set, at least in part, in accordance with the thermal capacitance of the response characteristic of the temperature sensor.

29. A fixing system comprising a fixing roller having associated heating means for heating said fixing roller, a press roller in contact with the fixing roller under pressure for holding and transporting a recording paper between the fixing roller and the press roller to fix a toner image on the recording paper and a temperature sensor for sensing the temperature of the fixing roller, wherein said temperature sensing sensor senses a fixing temperature, a boundary temperature and a paper feed start temperature for starting to feed papers, said boundary temperature being between said fixing temperature and said paper feed start temperature, said system further comprising a control means responsive to said temperature sensor for energizing said heating means in accordance with different energization patterns depending on whether the temperature sensed by said temperature sensor has reached the paper feed start temperature, the boundary temperature or the fixing temperature.

30. A fixing system comprising a fixing roller having associated heating means for heating said fixing roller, a press roller in contact with the fixing roller under pressure for holding and transporting a recording paper between the fixing roller and the press roller to fix a toner image on the recording paper and a temperature sensor for sensing the temperature of the fixing roller, said system further comprising a recording unit for forming said toner image, a document reading unit for reading the image of a document and a network controller for receiving image information therefor, and a control means for starting the reception of a signal or copy operation based on a signal received by said network controller, or a copy command signal from said document reading unit, said control means controlling the heating of said heating means, such that when the value of temperature sensed by said temperature sensor reaches a fixing temperature, the energization of said heating means is interrupted, and thereafter said heating means is energized for a predetermined time when the temperature sensed by said temperature sensing means drops below said fixing temperature and deenergizing for a predetermined time just after the energization, said control means completely stopping the energization of said heating means upon the completion of said signal reception or said copy operation.

31. A fixing system according to claim 1 or 30, wherein said control means immediately interrupts the energization of said heating means when the value of temperature sensed by said temperature sensor again reaches said fixing temperature after first falling below said fixing temperature.

32. A method for controlling the temperature of a fixing roller which is heated by a heater and has an associated temperature sensor for sensing the temperature of the fixing roller, said method comprising the steps of:

energizing said heater for a first period of time and then deenergizing the heater for a second period of time, after the value of temperature sensed by said temperature sensor reaches a fixing temperature; and, thereafter energizing said heater for a third predetermined time and then deenergizing said heater for a fourth predetermined time, when the value of temperature sensed by said temperature sensor drops below the fixing temperature.

33. A method as in claim 32, further comprising the steps of repeatedly energized and deenergized said heater after a boundary temperature, which is less than said fixing temperature, is sensed by said temperature sensor.

34. A method as in claim 33, further comprising the step of continuously energizing said heater upon the initiation of an image copying or image receiving operation, until said temperature sensor senses said boundary temperature.

35. A method as in claim 34, further comprising the step of stopping all energizing of said heater when a copying or image receiving operation of a machine containing said fixing roller ceases.

36. A method as in claim 32, further comprising the step of storing said predetermined periods of time in a memory.

37. A method as in claim 36, further comprising the step of initiating a paper feed operation for a fixing system which includes said fixing roller, when said temperature sensor first senses a paper feeding temperature which is below said boundary temperature.

38. A method as in claim 32, wherein said periods of time for energizing and deenergerizing said heater are defined by stored duty ratio information and said method further comprises the step of storing said duty ratio information.

39. A method as in claim 38, further comprising the step of storing initial energization/deenergization time period information for each of a plurality of selectable recording paper sizes, determining a selected recording paper size and using the initial energization/deenergization time period information corresponding to a selected recording paper size for controlling said heater.

40. A method as in claim 39, further comprising the step of storing for each of said selectable recording paper sizes, as said initial energization/deenergization time period information, an initial value for an energization/deengerization ratio for said heater and at least one of: (1) a heater "on" time, (2) a heater "off" time, and (3) a heater total cycle time, and determining the initial energizing and deenergizing time periods from said initial energization/deengerization time period information.

41. A method as in claim 40, wherein said ratio and at least one of (1) a heater "on" time, (2) a heater "off" time , and (3) a heater total cycle time are based on thermal characteristics of a fixing system which includes said fixing roller.

42. A method as in claim 40, wherein said ratio and at least one of (1) a heater "on" time, (2) a heater "off" time, and a heater total cycle time are based on the feeding frequency of recording papers through a fixing system which includes said fixing roller.

43. A method as in claim 39, further comprising the steps of counting the number of recording papers which are fixed by said fixing roller, storing energization/deenergization changing information and a sheet threshold number for each of said plurality of selectable recording paper sizes, changing said initial energization/deenergization time period information, selected in accordance with the size of the recording paper, in accordance with said energization/deenergization changing information, and using the changed energization/deenergization information to control said heater when the counted number reaches the threshold sheet number corresponding to the size of the selected recording paper.

44. A method as in claim 39, further comprising the step of counting a continuous operation time of a fixing system which includes said fixing roller, storing energization/deengerization changing information and a predetermined continuous operation time for said fixing system, changing said initial energization/deengerization time period information, in accordance with said energization/deengerization changing information, and using the changed energization/deengerization time period information to control said heater when said timer reaches said predetermined continuous operation time.

45. A method as in claim 44, further comprising the step of said storing as said initial energization/deenergization time period information an initial value for an energization/deengerization duty ratio and at least one of: (1) a heater "on" time, (2) a heater "off" time, and a heater total cycle time, and the determining the initial energizing and deenergizing time periods from said initial energization/deengerization time period information.

46. A method as in claim 45, wherein said ratio and at least one of: (1) a heater "on" time, (2) a heater "off" time, and (3) a heater total cycle time are based on thermal characteristics of a fixing system which includes said fixing roller.

47. A method as in claim 45, wherein said ratio and at least one of: (1) a heater "on" time, (2) a heater "off" time, and (3) a heater total cycle time are based on the feeding frequency of recording papers through a fixing system which includes said fixing roller.

48. A method as in claim 38, further comprising the step of storing initial energization/deenergization time period information, and retrieving and using the stored initial energization/deengerization time period information for controlling said heater.

49. A method as in claim 48, further comprising the step of storing as said initial energization/deengerization time period information, an initial value for an energization/deenergization ratio for said heater, and at least one of: (1) a heater "on" time, (2) a heater "off" time and (3) a heater total cycle time, and determining initial energization and deengerization time periods from said initial energization/deengerization time period information.

50. A method as in claim 49, wherein said duty ratio and at least one of (1) a heater "on" time, (2) a heater "off" time, and (3) a heater total cycle time are based on the thermal characteristics of a fixing system which includes said fixing roller.

51. A method as in claim 49, wherein said duty ratio and at least one of: (1) a heater "on" time, (2) a heater "off" time, and (3) a heater cycle time are based on the characteristics of the feeding frequency of recording papers through a fixing system which includes said fixing roller.

52. A method as in claim 48, further comprising the steps of counting the number of recording papers which are fixed by said fixing roller, storing energization/deenergization changing information and a sheet threshold number for each of said plurality of selectable recording paper sizes, and changing said initial energization/deenergization time period information for a selected recording paper in accordance with said energization/deenergization changing information for said selected recording paper, and using the changed energization/deenergization time period information to control said heater when the counted number reaches the threshold sheet number corresponding to the size of the selected recording paper.

53. A method as in claim 32, wherein said energization of said heater is immediately interrupted when the value of temperature sensed by said temperature sensor reaches said fixing temperature.

54. A method as in claim 32, wherein at least one of said energization and deenergization periods is set, at least in part, in accordance with the thermal capacitance of the fixing roller and an associated pressing roller.

55. A method as in claim 32, wherein at least one of said energization and deenergization periods is set, at least in part, in accordance with the thermal capacitance of the electric power of the heater.

56. A method as in claim 32, wherein at least one of said energization and deenergization periods is set, at least in part, in accordance with the thermal capacitance associated with image area of a recording paper.

57. A method as in claim 32, wherein at least one of said energization and deenergization periods is set, at least in part, in accordance with the thermal capacitance associated with a line velocity of a recording paper through a fixing system which includes said fixing roller.

58. A method as in claim 32, wherein at least one of said energization and deenergization periods is set, at least in part, in accordance with the thermal capacitance of the input electric power to a machine which includes said fixing roller.

59. A method as in claim 32, wherein at least one of said energization and deenergization periods is set, at least in part, in accordance with the thermal capacitance of the response characteristic of the temperature sensor.

60. A method for controlling the temperature of a fixing roller which is heated by a heater and has an associated temperature sensor for sensing the temperature of the fixing roller, said method comprising the steps of: sensing the temperature of the fixing roller with said temperature sensor, said temperature sensing sensor sensing a fixing temperature, a boundary temperature and a paper feed start temperature for the start of a paper feed operation of a fixing system which includes fixing roller, said boundary temperature being between said fixing temperature and said paper feed start temperature, and energizing said heater in accordance with different energization patterns in accordance with whether the temperature sensed by said temperature sensor has reached the paper feed start temperature, the boundary temperature, or the fixing temperature.

61. A method for controlling the temperature of a fixing roller which is heated by a heater and has an associated temperature sensor for sensing the temperature of the fixing roller, said method comprising the steps of: controlling the heating of said heater such that said heater is energized for at least some period of time and when the value of temperature sensed by said temperature sensor reaches a fixing temperature, the energization of said heater is interrupted, and thereafter said heater is energized for a predetermined time when the temperature sensed by said temperature sensing means drops below said fixing temperature and deenergizing for a predetermined time just after the energization, the energization of said heater being completely stopped upon the completion of a signal reception or copy operation of a machine which contains said fixing roller.

62. A method according to claim 61, wherein the energization of said heater is immediately interrupted when the value of temperature sensed by said temperature sensor again reaches said fixing temperature after first falling below said fixing temperature.

* * * * *